US006486454B1

(12) United States Patent
Ryu

(10) Patent No.: US 6,486,454 B1
(45) Date of Patent: Nov. 26, 2002

(54) MICROWAVE OVEN USING DUAL CLOCK

(75) Inventor: Han-Gyu Ryu, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 48 days.

(21) Appl. No.: 09/713,245

(22) Filed: Nov. 16, 2000

(30) Foreign Application Priority Data

Sep. 1, 2000 (KR) ..... 00-51610

(51) Int. Cl.[7] ..... H05B 6/68

(52) U.S. Cl. ..... 219/719; 219/720

(58) Field of Search ..... 219/719, 720, 219/715, 716, 717, 718

(56) References Cited

U.S. PATENT DOCUMENTS 4,582,971 A * 4/1986 Ueda ..... 219/685
4,686,356 A * 8/1987 Ueda et al. ..... 219/482
4,812,627 A 3/1989 Wexler et al.

FOREIGN PATENT DOCUMENTS

JP 2000046336 * 2/2000

* cited by examiner

*Primary Examiner*—Teresa Walberg
*Assistant Examiner*—Quang Van
(74) *Attorney, Agent, or Firm*—Larson & Taylor, PLC

(57) ABSTRACT

A microwave oven using a dual clock allows a microcomputer to have two operation modes, preserves a memory data of a microwave oven in case of a power failure, and minimizes a power-consumption of a battery. The microwave oven having a power-supply part, a load driver and a display part includes an oscillation part for generating many clocks having a different frequency, a control unit for setting at least one among many clocks from the oscillation part as an operation clock according to a power-supply of the power-supply part; and an auxiliary power-supply part for providing a power-supply to the control unit if the power-supply part does not generate a power-supply. If a power-supply is normally applied to a microwave oven, a dual mode is set, and a general mode of using the main clock and the sub clock as an operation clock is set. If a power-supply is not provided to a microwave oven, the main clock is turned off, a power-saving mode of using the sub clock as an operation clock is set.

7 Claims, 3 Drawing Sheets

MICROWAVE OVEN USING DUAL CLOCK

BACKGROUND OF THE INVENTION (1) Field of the Invention

The present invention relates to a microwave oven using a dual clock. More particularly, it relates to a microwave oven using a dual clock which allows a microcomputer to have two operation modes, preserves a memory data of a microwave oven in case of a power failure, and minimizes a power-consumption of a battery.

(2) Description of the Prior Art

Generally, a conventional microwave oven applies a power-supply to a printed circuit board(PCB) from an external power-supply unit. The PCB applies a power-supply to the microcomputer so that a microcomputer is driven. However, if a power-failure occurs, all operations of the microcomputer are stopped, a clock data and a user-selected data are lost.

In the meantime, in case of a microwave oven designed by a power-failure consideration, a microcomputer is driven only by one main clock, a battery power-consumption becomes higher, a power-failure standby time becomes shorter so that the microcomputer stops operating if a power-failure time becomes longer, thereby a data memorized before the power-failure is lost.

SUMMARY OF THE INVENTION

Accordingly, the present invention is directed to a microwave oven using a dual clock that substantially obviate one or more of the problems due to limitations and disadvantages of the related art.

It is an objective of the present invention to provide a microwave oven using a dual clock which allows a microcomputer to have two operation modes, preserves a memory data of a microwave oven in case of a power failure, and minimizes a power-consumption of a battery.

To achieve the above objective, in a microwave oven having a load driver for driving a load after receiving a power-supply from a power-supply part, and a display part for displaying each information to the outside, a microwave oven using a dual clock includes: an oscillation part for generating many clocks having a different frequency; a control unit for setting at least one among many clocks from the oscillation part as an operation clock according to a power-supply of the power-supply part; and an auxiliary power-supply part for providing a power-supply to the control unit if the power-supply part does not generate a power-supply.

A method for controlling a microwave oven which is operated as a dual mode by using a main clock and a sub clock includes the steps of: if a power-supply is normally applied to a microwave oven, setting a dual mode, and setting a general mode using the main clock and the sub clock as an operation clock; and if a power-supply is not provided to a microwave oven, turning off the main clock, and then setting a power-saving mode of using the sub clock as an operation clock.

BRIEF DESCRIPTION OF THE DRAWINGS

Further objects and other advantages of the present invention will become apparent from the following description in conjunction with the attached drawings, in which.

DETAILED DESCRIPTION OF THE PREFERRED EMBODIMENTS

The preferred embodiments of the present invention will now be described in detail with reference to the accompanying drawings.

Figure 1:
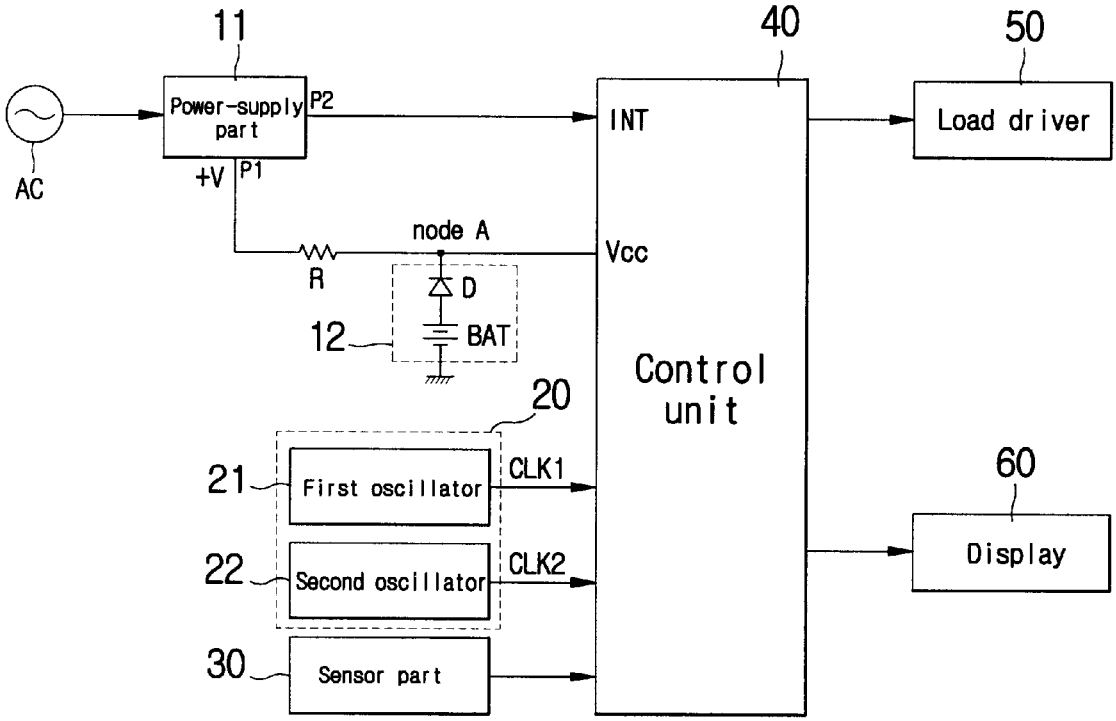
FIG. 1 depicts a block diagram of a microwave oven using a dual clock according to the present invention.

FIG. 1 is a block diagram of a microwave oven using a dual clock according to the present invention.

As shown in FIG. 1, a microwave oven according to the present invention includes a power-supply part 11, an oscillation part 20, and a sensor part 30. The power-supply part 11 converts AC voltage to DC voltage(+V), and provides the DC voltage(+V) to a controller 40. The oscillation part 20 includes a first oscillator 21 for generating a main clock CLK1 of a predetermined frequency and a second oscillator 22 for generating a sub clock CLK2 of a predetermined frequency. The main clock CLK1 is provided to control all operations of a microwave oven, and has a frequency of about 4.19 MHz. The sub clock CLK2 is provided to drive a clock mounted into a microwave oven, and has a lower frequency as compared with the main clock CLK1. If a power-supply is normally provided to a microwave oven, the control unit 40 is driven by using both the main clock CLK1 from the first oscillator 21 and the sub clock CLK2 from the second oscillator 22.

In the meantime, an auxiliary power-supply unit 12 is connected between the node A and a ground so that a power-supply is successively provided to the control unit 40 in case of a power-failure. The auxiliary power-supply unit 12 includes a diode D and a battery BAT connected in series to each other. If a power-failure occurs, a potential of the node A becomes lowered, the battery BAT provides a power-supply to an input port Vcc of the control unit 40.

Figure 2:
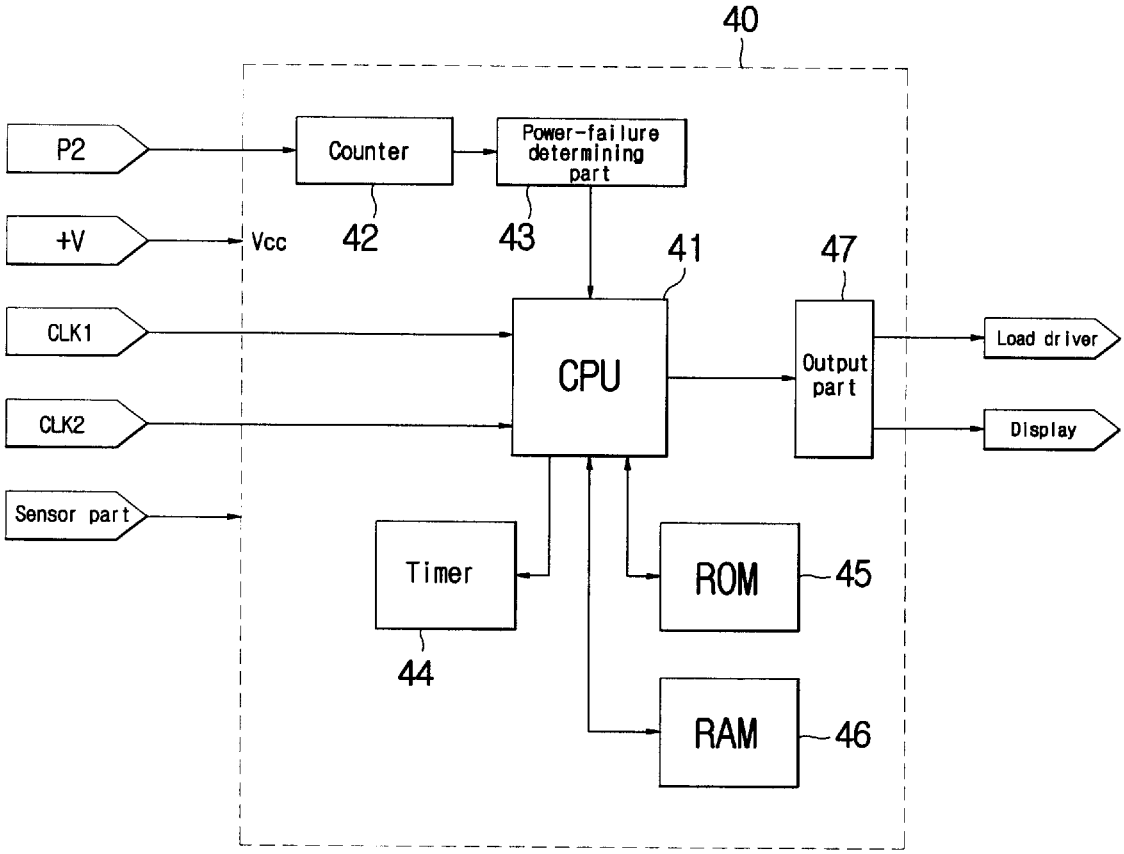
FIG. 2 depicts a detailed diagram of a control unit of a microwave oven using a dual clock according to the present invention.

FIG. 2 depicts a detailed diagram of the control unit 40 of a microwave oven using a dual clock.

As shown in FIG. 2, the control unit 40 includes CPU 41, a counter 42, a power-failure determining part 43, a timer 44, ROM 45, RAM-46 and an output part 47. The CPU 41 entirely controls an operation of the microwave oven. The counter 42 counts the number of halfwave-rectified signal pulses generated from the power-supply part 11. The power-failure determining part 43 determines whether a power-failure occurs or not according to the counted result of the counter 42. The timer 44 sets a clock time by using the sub clock CLK2 according to a control of the CPU 41. The ROM 45 stores a control program of the CPU 41 therein. The RAM 46 stores a user-input data. The output part 47 outputs a control signal to the load driver 50 and the display part 60.

Figure 3:
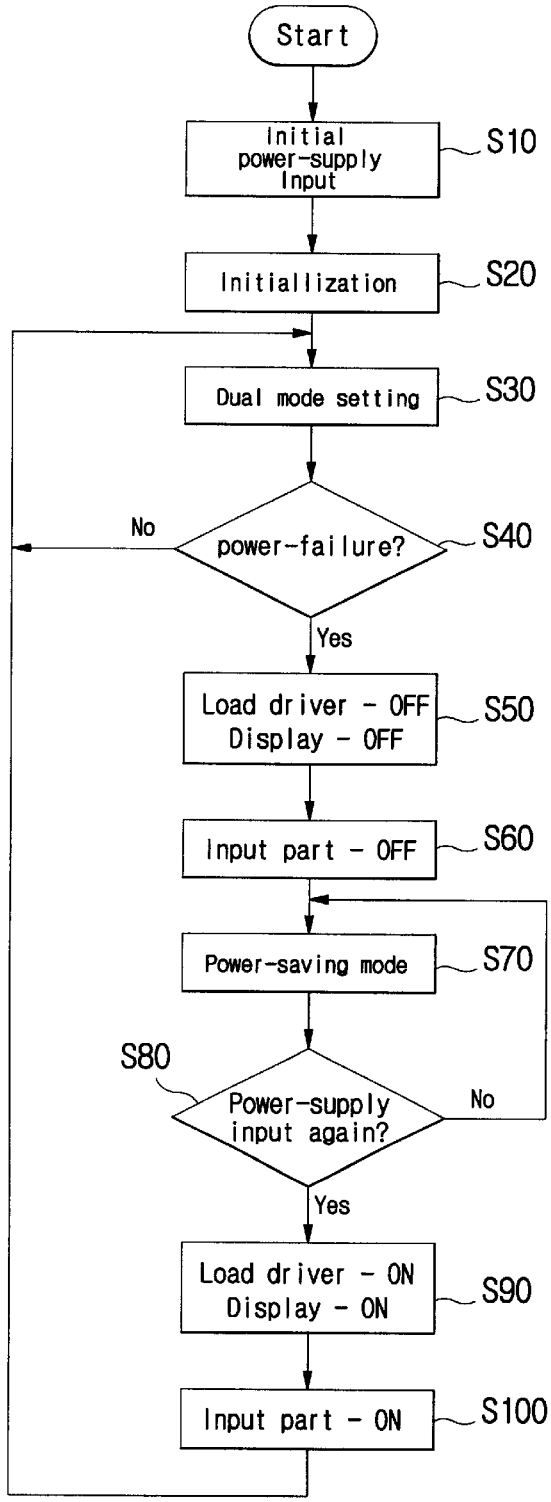
FIG. 3 depicts a flowchart showing an operation of a microwave oven using a dual clock.

The aforementioned microwave oven will be operated as follows. FIG. 3 is a flowchart showing an operation of a microwave oven using a dual clock according to the present invention.

As shown FIG. 3, if a power-supply Vcc from a power-supply part 11 is provided to a microwave oven in step S10, a control unit 40 performs a system initialization in step S20. Then, the control unit 40 sets a dual mode in order to allow a microwave a oven to be operated as two operation modes in step S30. If the dual mode is set in the step S30, the microwave oven has two 43, operation modes. One of two operation modes is a general mode which is an operation mode before a power-failure, and the other one is a power-saving mode after the power-failure.

In case of the general mode, the CPU 41 uses both the main clock CLK1 and the sub clock CLK2. At this time, the CPU 41 is operated by the main clock CLK1 of about 4.19 MHz, and drives the timer 44 by the sub clock CLK2 so as to calculate a current clock time.

After a dual mode is set in the step S30, the CPU 41 determines S40 whether a power-failure or not by using the power-failure determining part 43. The step S40 will be described below in detail. The counter 42 counts the number of halfwave-rectified AC output pulses generated from the power-supply part 41. In general, since a frequency of a common AC voltage is 60 Hz, a frequency of a halfwave-rectified AC voltage is 60 Hz. That is, if a power-failure is not generated, the counter 42 counts 60 pulses per a unit time(i.e., 1 second), performs a resetting operation every unit time, and then performs a counting operation.

Therefore, if the counter 42 counts 60 pulses during the unit time, the power-failure determining part 43 determines a current power-supply state as a normal state. However, if the counter 42 stops a counting operation or 60 pulses per a unit time is not counted by the counter 42, the power-failure determining part 43 determines a current power-supply state as a power-failure state, and outputs a power-failure signal to the CPU 41. If a power-failure occurs, a power-supply voltage (+V) is not generated from a power-supply part 11, a potential of node A is changed from a potential (+V) to a ground potential. At this time, a potential difference between a positive terminal (+) of a battery BAT and a node A occurs, a power-supply of the battery B AT is provided to a power-supply port Vcc of the control unit 40 through a diode D.

Although the aforementioned preferred embodiment sets a unit time as 1 second and sets the number of pulses as 60, the scope of this invention is not limited to the above examples, it is understood that various other modifications will be apparent to and can be readily made by those skilled in the art without departing from the scope and spirit of this invention.

A power-failure signal is generated from a power-failure determining part 43 in the step S40, the CPU 40 determines a power-failure state, disables an output part 47, turns off the load driver 50 and the display part 60 in step S50, turns off a function input part (not shown) in step S60. So, the user cannot input a function to a microwave oven.

After that, the CPU 41 changes its own operation state to a power-saving mode in step S70. For the power-saving mode, the CPU 41 changes its own operation clock from a main clock CLK1 of the first oscillator 21 to a sub clock CLK2 of the second oscillator 22, thereby lowering an operation frequency. The CPU 41 drives RAM 46 having a user-selected data and the timer 44 setting a clock by using a sub clock CLK2. Therefore, a total operation frequency becomes lowered, and a microwave oven can be driven with a low power and maintains a standby state during a power-failure so that a clock data and a user-selected data can be preserved.

After that, the CPU 41 determines whether a power-supply is applied again or not by an output signal of the power-failure determining part 43. The power-failure determining part 43 determines that a power-supply is applied again if the counter 42 counts 60 pulses per a unit time, and outputs a power-failure release signal.

If the power-failure determining part 43 outputs the power-failure release signal, the CPU 41 enables an output part 47, turns on the load driver 50 and the display part 60 in step S90, and turns on the function input part in step S100.

Then, the CPU 41 returns to the step S30, sets a dual mode again such that an operation state of the CPU 41 is changed from a power-saving mode using a sub clock CLK2 to a general mode using dual clocks CLK1 and CLK2. In other words, an operation clock of the CPU 41 is changed from a sub clock CLK2 of the second oscillator 22 to a main clock CLK 1 of the first oscillator 21, so that an operation frequency becomes higher. At this time, an operation clock of the timer 44 is maintained as a sub clock CLK2.

As described above, the microwave oven using a dual clock according to the present invention allows a microcomputer to have two operation modes(i.e., dual mode), in contrast with a conventional microwave oven's microcomputer of only using a main clock. Therefore, if a power-failure occurs, the microwave oven preserves a memory data(i.e, a reserved cooking function) which is input by the user before the power-failure. If a power-supply is applied again to the microwave oven, a user needs not to perform additional user-selection step, a function by the memory data such as the reserved cooking function can be directly performed, thereby increasing a user's convenience.

In addition, under the power-failure state, the microwave oven does not use a main clock and uses only a sub clock, thereby minimizing a power-consumption of a battery.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art which this invention pertains.

What is claimed is:

1. A microwave oven having a load driver for driving a load after receiving electrical power from a power-supply part, and a display part for displaying each information, a microwave oven using a dual clock comprising:

an oscillation part for generating many clocks having a different frequency;

a control unit for setting at least one among many clocks from the oscillation part as an operation clock according to the electrical power of the power-supply part; and an auxiliary power-supply part for providing electrical power to the control unit if the power-supply part does not generateelectrical power.

2. The microwave oven according to claim 1, wherein the oscillation part includes:

a first oscillator for generating a main clock of a predetermined frequency; and a second oscillator for generating a sub clock having a lower frequency than the predetermined frequency of the main clock.

3. The microwave oven according to claim 1, wherein the auxiliary power-supply part includes a diode and a battery which are positioned between a node to which the power-supply part and the control unit are connected to each other and a ground, and connects the diode and the battery in series.

4. The microwave oven according to claim 1, wherein the control unit includes:

a counter for counting the number of pulses of an output signal of the power-supply part;

a power-failure determining part for determining whether a power-failure occurs or not according to a counted result of the counter;

a central processing unit (CPU) for setting at least one between the main clock and the sub clock as an operation clock according to a determined result of the power-failure determining part;

a timer for setting a clock time by using the sub clock;

ROM for storing a control program of the central processing unit (CPU) therein;

RAM which stores a user-input data therein, and is driven by one between the main clock and the sub clock according to a control signal of the central processing unit (CPU); and an output part for controlling the driving of the load driver and the display part according to a control signal of the central processing unit (CPU).

5. The microwave oven according to claim 4, wherein the central processing unit (CPU) turns off an output part in case of a power-failure, and turns off the load driver and the display part.

6. A method for controlling a microwave oven which is operated as a dual mode by using a main clock and a sub clock comprising the steps of:

if a power-supply is normally applied to the microwave oven, setting the dual mode, and setting a general mode using the main clock and the sub clock as an operation clock; and if a power-supply is not provided to a microwave oven, turning off the main clock, and then setting a power-saving mode of using the sub clock as the operation clock.

7. The method according to claim 5, wherein:

if the power-saving mode is set, a load driver and information display function are turned off, and a clock data display function and a user-selected data are preserved.

* * * * *